United States Patent [19]

Keith

[11] Patent Number: 4,599,004

[45] Date of Patent: Jul. 8, 1986

[54] CONTINUOUS MIXING TANK FOR LIQUID SPRAY CHEMICALS

[76] Inventor: Daniel Keith, Star Rte. #A, Box 195, Hobbs, N. Mex. 88240

[21] Appl. No.: 660,272

[22] Filed: Oct. 12, 1984

[51] Int. Cl.[4] ..... B01F 7/04

[52] U.S. Cl. ..... 366/241; 366/64; 366/176; 366/292; 366/312

[58] Field of Search ..... 366/302, 307, 309, 64, 366/66, 292, 235, 87, 176, 603, 293, 312

[56] References Cited

U.S. PATENT DOCUMENTS

| | | | |
|---|---|---|---|
| 606,811 | 7/1898 | Ottenger . | |
| 1,329,786 | 2/1920 | Mabee . | |
| 1,642,445 | 9/1927 | Jacobson . | |
| 2,240,841 | 5/1941 | Flynn | 366/307 |
| 2,893,846 | 7/1959 | Wistrich | 366/307 |
| 3,203,631 | 8/1965 | Jutila | 239/124 |
| 3,310,237 | 3/1967 | Welch | 239/127 |

*Primary Examiner*—R. W. Jenkins

*Attorney, Agent, or Firm*—Kimmel, Crowell & Weaver

[57] ABSTRACT

A mixing and agitating device having an elongated container for holding liquid chemicals to be thoroughly mixed and dispensed has a pair of access holes for permitting entrance thereto, and a baffle structure midway within the container for separating same into two equal compartments. The baffle structure is provided with a plurality of six elongated apertures or slots, the upper three having the central one vertically mounted and the other two spaced on either side thereof at an angle of preferably 45° from the vertical. The lower three slots have the central one mounted horizontally and the other two on either side thereof at an angle of approximately 45° from the vertical. A modified embodiment is provided wherein the lower angled pair of slots are at an angle of 30° from the vertical. However, the range of slot angles can be from 25° to 55° from the vertical.

A longitudinal drive shaft driven externally by a gasoline motor, extends through the container, and a pair of L-shaped paddles are mounted on the shaft within the first compartment with the angles of the L's facing in one direction. The second compartment has another pair of L-shaped paddles, with the L's facing in the opposite direction to the first pair of paddles. Also, the respective pairs of dual paddles are arranged at approximately right angles to each other.

9 Claims, 4 Drawing Figures

CONTINUOUS MIXING TANK FOR LIQUID SPRAY CHEMICALS

BACKGROUND OF THE INVENTION

1. Field of the Invention

This invention relates generally to devices for spraying liquid chemicals in a field or orchard, and especially for maintaining the chemicals in a completely mixed state and without any possibility of settling or deterioration of the component elements.

2. Description of the Prior Art

A common problem of known type mixing devices for use with liquid chemicals is that they fail to completely and thoroughly mix the chemicals and/or fail to maintain them in the properly mixed state during an entire dispensing operation.

Another common problem of known type mixing devices is that they do not mix the elements thoroughly and completely enough as is necessary for a proper spraying operation.

A further problem with known type devices is that they are not as effective in the mixing of liquids and chemicals as is desired, and thus pockets of incompletely mixed material oftentimes exist in the over-all batch.

Existing prior patents which may be pertinent to the present invention are as follows:

U.S. Pat. No. 606,811 7/5/1898
U.S. Pat. No. 1,329,786 2/3/20
U.S. Pat. No. 1,642,445 9/13/27
U.S. Pat. No. 3,203,631 8/31/65
U.S. Pat. No. 3,310,237 3/21/67

U.S. Pat. No. 1,329,786 discloses mixing apparatus including an L-shaped paddle. However, this invention is for mixing tomatoe and tomatoe products while cooking, and would not produce the desired results of the present invention.

U.S. Pat. No. 3,203,631 discloses a tank provided with a motorized agitating element positioned therein, mounted in a manner similar to that of the present invention. The same is generally true with regard to U.S. Pat. No. 1,642,445, but neither device would produce the desired results of the present invention.

U.S. Pat. No. 606,811 relates to a spraying device for use in orchards and the like, disclosing an elongated tank provided with a plurality of mixing paddles or arms positioned in the lower portion of the tank, the arms being adapted to be rotated through gearing associated with the wheels of the vehicle. However, this device is a pressurized sprayer and the paddles are too low and will not mix the upper part of the tank. The paddles are flat and have no angles for lifting the liquid.

A similar arrangement is shown in U.S. Pat. No. 3,310,237, although the mixing element is serpentine in nature, and the agitator is driven through a motorized unit. However, this patent is for mixing slurries that are applied as dry particulate materials.

Thus, none of the known prior art devices offers the new and novel features of the present invention.

SUMMARY OF THE INVENTION

An object of the present invention is to provide a continuous mixing device for spraying liquid chemicals in orchards, fields and the like, and which will thoroughly and completely mix and agitate the chemicals to be sprayed.

Another object of the present invention is to provide a mixing device which is transportable and self-contained, and includes a spraying pump together with a mixing container, with a pair of agitating paddle structures for continuously mixing liquid chemicals during the entire spraying operation.

A further object of this invention is to provide a mixing device having a longitudinal shaft with a dual pair of L-shaped paddles spaced along said shaft, the L-shaped paddles of the respective pairs being positioned in opposite directions to each other, and the pair of paddles being separated from each other by a diffusing baffle structure. The baffle structure has a plurality of six elongated apertures therein spaced at specific angles which have been found to be most effective in the mixing and agitating process.

A still further object of the present invention is to provide a mixing container having a baffle approximately midway thereof for dividing the container into two substantially equal parts, each part having an agitating paddle structure therewithin, one paddle structure being at substantially right angles to the other paddle structure, and a common shaft for continuously rotating both paddle structures together. Slots at predetermined angles within the baffle structure increase the effectiveness thereof in a very substantial manner.

Another further object is to provide a baffle arrangement within a mixing container having a central baffle with slots at angles in the range of 25° to 55° from the vertical center line of the structure.

The present invention has a number of new and novel features. Among them are a container having a baffle structure midway therein which greatly improves the speed and effectiveness of the mixing of liquid chemicals. The container is designed to be completely sealed once the liquid chemicals have been inputted thereto, and includes a pair of paddles in one compartment, with a second pair of paddles in a second compartment. Both pairs of paddles are mounted on a common shaft which runs longitudinally through the liquid containing compartments.

It is very important for the desired beneficial results of the present invention to be achieved, that the dual pair of paddles be offset at approximately right angles to each other. Also, each paddle is of L-shaped configuration, and it has been found to be desirable for the L's of the paddles of the first pair to be opposite in direction to the L's of the second pair. These features increase the effectiveness of the mixing/agitating process.

The baffle midway of the liquid chemical containing tank has a plurality of elongated apertures or slots therethrough for also increasing the effectiveness of the mixing and agitating process. Preferably, three slots are provided in the upper half of the baffle and three slots in the lower half. The upper slots have the central slot extending vertically, while the other two slots are on each side thereof and at an angle of approximately 45° to the vertical. The lower three slots have the center slot horizontally positioned, while the other two slots are at each end thereof at an angle, in the primary embodiment of 45°, and in the secondary embodiment of 30°. It has also been discovered that angles in the range of 25° to 55° will all function quite well; however, the preferred embodiment of 45° appears to work the very best.

A dispensing outlet is provided at the front end of the container for direct coupling to a sprayer pump for dispensing the liquid chemicals in the desired spray manner. It should be noted that a gasoline engine is mounted on the overall transportable device for continuously driving the mixing paddles as well as for providing power for the spray pump when needed during the actual spraying operation. By this arrangement, the mixing can continue through the entire spraying operation which achieves the desired results of preventing any settling or undesired sediment processes to occur in the liquid chemicals, thus possibly rendering them impotent, and thus assuring that the over-all quality of the job will be of the very highest quality.

Access holes at the top of the container permit easy access to the inside of the tank for quick and easy cleaning of the tank as is necessary during general maintenance procedures.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT(S)

Figure 1:
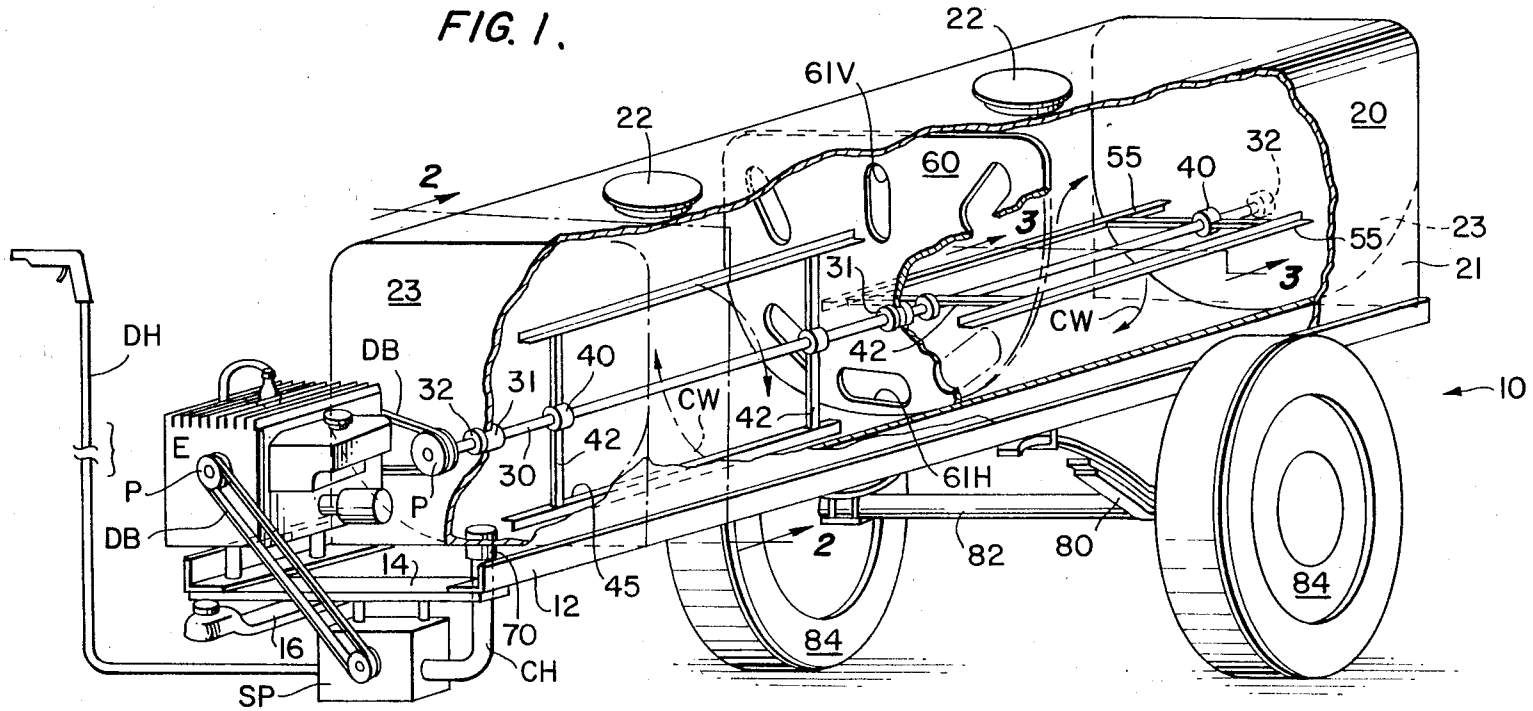
FIG. 1 is a perspective view of the over-all mixing and agitating device of the present invention.

Looking at FIG. 1 of the drawings, reference numeral 10 indicates in general the mixing device of the present invention. A pair of angle iron rails 12 are provided, having traverse plate portions 14 affixed thereto at each end thereof. A tow bar 16 having a trailer hitch or the like affixed thereto is also attached at what will be the front end of the device. An elongated container or tank 20 is provided having a covered top 21 and a curved bottom portion 23. Extension sides 21 support the tank as one continuous leg on each side of the tank from the respective side rails 12. A pair of rectangular plates 23' with semi-circular bottoms complete the tank construction.

A baffle plate 60 of similar configuration to the end plates 23 is affixed approximately midway of the elongated tank, so that the tank will substantially be divided into two equal parts. Contained within each of the respective parts are mixing and agitating paddle structures. An elongated shaft 30 for mounting the paddles and driving same extends longitudinally through the interior of the tank. Bearings 31 and oil seals 32 appropriately mounted in each of the end plates 23 and the baffle 60 support the drive shaft 30. The pair of dual paddle structures are mounted on hubs 40 affixed to the longitudinal shaft 30 and have extension arms 42 affixed and extended therefrom. On the ends of each of the extension arms 42 are provided L-shaped paddles 45 and 55. The configuration of the paddles 45 and 55 is basically the same, however, the difference is that the paddles 45 in the first compartment have the projecting portion of the L extending outwardly from the stem and faces in the direction of clockwise rotation CW of the drive shaft 30 as depicted in FIG. 1, while the paddles 55 in the second compartment on the second mixing-/agitating structure face with the extending portions of the L facing backwardly or in the opposite direction from that of the first set of paddles 45. Also, it should be noted that the second pair of paddles are orientated at right angles to the first pair. This combination of opposite orientation of the L-shaped paddles themselves and the right angle offset of the dual pair of paddle structures plays a great part in the more effective mixing and agitating method effected by the present invention.

Figure 2:
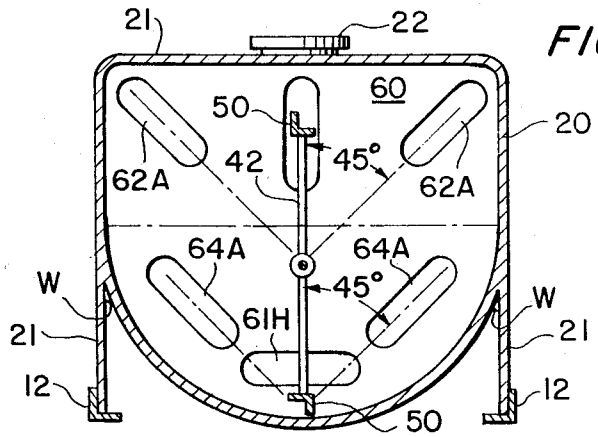
FIG. 2 is an elevational view, taken generally along lines 2—2 of FIG. 1.

The increased effectiveness is further achieved by the use of a plurality of six elongated apertures or slots through the baffle plate 60. The upper three slots are arranged with the center slot 61V bearing orientated in the vertical direction. The two slots 62A at the respective sides thereof are angled at, as shown in FIG. 2, an angle of approximately 45° from the vertical.

Similarly, the lower three slots comprise a central horizontally arranged slot 61H, with two slots 64A at either end thereof appropriately angled at a similar preferred angle of 45° from the vertical. It has been discovered in actual practice and tests that the combination of the angle slots, the dual paddle structures with offset paddle blades and reverse L paddles all perform a very effective, continuous mixing and agitating action. They also pick up liquids from the very bottom of the container tank because, as can best be seen in FIG. 2, when the lowermost paddle blade passes by the curved surface 23 of the lower part of the tank, it is very close to the bottom for maximum effectiveness.

Access hole apertures or openings 22 are provided for each of the respective compartments for permitting easy access for cleaning and the like of the dual compartments.

The drive shaft 30 extends through the front end 23 of the tank and is suitably driven by a pulley P and drive belt DB from a gasoline engine E.

The over-all device is mounted by springs 80 on an axle 82 having a pair of wheels 84 thereon. This permits easy and ready transporting of the over-all device and permits continuous mixing and agitating even while the device is being transported and/or while the liquid chemicals are being dispensed therefrom.

It is desired, in many applications, to use this structure for spraying purposes, such as in food orchards, and when so used, a coupling hose CH from the outlet 70 at the front of the lower portion of the tank is appropriately coupled to a spray pump SP and a dispenser hose DH for the spraying operation. Spray pump SP is appropriately coupled by drive belt DB to the gasoline engine E. Thus, it can be easily visualized, the mixing and agitating of the liquid chemicals can transpire throughout the entire spraying operation, thus avoiding any possibility of chemical solids settling out, or chemical elements deteriorating because of resting still.

Figure 3:
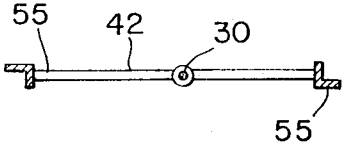
FIG. 3 is an elevational view, taken generally along lines 3—3 of FIG. 1.

FIG. 3 shows the reversed direction of the second pair of paddle blades 55 with respect to the first pair 45.

Figure 4:
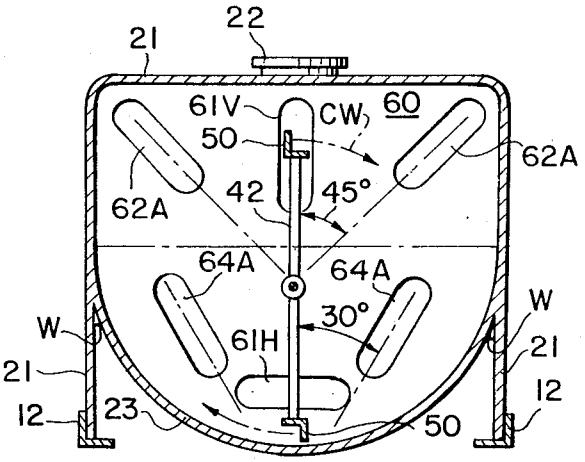
FIG. 4 is an elevational view similar to that of FIG. 2, showing a modified embodiment of the baffle with slot structure of the present invention.

FIG. 4 shows another embodiment of the present invention wherein the upper angled slots 62A are at an angle of 45° from the horizontal, while the lower angled slots 64A are at an angle of 30° from the vertical.

Other embodiments are also envisioned wherein the angles of both slots can be the same and of 30° or even less. It has been discovered by actual tests that a range of angles from 25° to 55° work quite well. However, the preferred embodiment with both angled slots at 45° appears to be the best for general purposes.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A transportation liquid chemical mixing device comprising an elongated container for holding liquid chemicals to be thoroughly mixed for a spraying operation;

baffle means dividing said elongated container into two parts;

first agitator means in one of said container parts;

second agitator means in the other of said container parts; and means for commonly driving both said first and second agitator means in a manner to effectively continuously move said liquid chemicals through said baffle means for thoroughly and completely mixing said liquid chemicals, the baffle means comprising a full baffle panel completely dividing the cross-sectional area of the container, said baffle being provided with a plurality of aperture means for increasing agitation of liquid chemicals flowing therethrough, said aperture means comprising six slots, three of said slots being in the lower portion of said baffle panel and three being in the upper portion of said baffle, the lower three slots having a center slot arranged horizontally and the other two slots being at each end thereof and at a predetermined angle thereto, and the upper three slots having a center slot arranged vertically and the other two at either side thereof and at a predetermined angle thereto.

2. A transportable liquid chemical mixing device of claim 1, wherein the angles of the end slots range from 25° to 50° from the vertical.

3. A transportable liquid chemical mixing device of claim 1, wherein said first agitating means includes a pair of paddles, each paddle being of L-shaped configuration.

4. A transportable liquid chemical mixing device of claim 3, wherein said second agitating means is similar to said first one and also includes a pair of L-shaped paddles, however, the projecting portion of said L's of the second agitating means being arranged to face the opposite direction from the same portion of the paddles of the first agitating means.

5. A transportable liquid chemical mixing device as set forth in claim 4, wherein said means for commonly driving said agitator means includes both pairs of paddles being mounted on a common drive shaft, one set of paddles being within a first compartment of said container and the other pair being within a second compartment thereof, and common drive means externally of the container being connected to said shaft for continuously driving same during operation of the device.

6. A transportable liquid chemical mixing device as set forth in claim 5, wherein said external drive means is a gasoline engine, and the container is permanently mounted upon a carriage platform having wheels for easy transporting same, and a spray pump with appropriate hoses also driven from said gasoline engine.

7. A mixing device comprising:

an elongated tank for holding liquid chemicals;

baffle structure approximately midway of said tank to divide same substantially into two equal parts;

an access opening above each part for permitting entrance to each said part;

elongated slots provided through the baffle structure for increasing the effectiveness of the agitating and mixing of liquid chemicals contained therewithin; and said slots including three slots through the upper half of the baffle structure and three slots through the lower half of the baffle structure, said elongated tank including a dual pair of paddles, each respective pair being in one of said two tank parts, and the respective pairs of paddles being orientated at right angles to each other in the respective parts of the tank, and said paddle structures being L-shaped and the bottom leg of each L of one pair of paddles faces in an opposite direction to the same portion of the second pair of paddles.

8. A mixing device as set forth in claim 7, wherein the upper set of slots has the middle one in a vertical position and the other two of said three slots are orientated at a predetermined angle to said vertical one and the lower three slots have the center slot arranged in a substantially horizontal position and the other two slots are orientated at a predetermined angle thereto.

9. A mixing device as set forth in claim 8, wherein the predetermined angles are in the range of 25° to 55°.

* * * * *